US005222343A

United States Patent [19]

Anderson

[11] Patent Number: 5,222,343

[45] Date of Patent: Jun. 29, 1993

[54] HOUSE TRIM PANELS FOR USE WITH SIDING AND METHOD OF ASSEMBLING THE PANELS

[76] Inventor: Carl Anderson, 2589 Richmond Ter., Staten Island, N.Y. 10303

[21] Appl. No.: 695,299

[22] Filed: May 3, 1991

Related U.S. Application Data

[63] Continuation-in-part of Ser. No. 394,484, Aug. 16, 1989, abandoned.

[51] Int. Cl.[5] ..... E06B 1/34; E04F 19/02

[52] U.S. Cl. ..... 52/718.04; 52/211; 52/288; 52/717.01; 52/717.05; 52/717.06

[58] Field of Search ..... 52/211, 212, 287, 288, 52/717.1, 718.1, 716

[56] References Cited

U.S. PATENT DOCUMENTS

| | | | |
|---|---|---|---|
| 3,422,584 | 1/1969 | Howard | 52/718.1 |
| 3,534,516 | 10/1970 | Cooper | 52/212 |
| 3,609,928 | 10/1971 | Mock | 52/718.1 |
| 3,875,713 | 4/1975 | Laborde | 52/288 |
| 3,906,671 | 9/1975 | Maldonado | 52/212 |
| 4,281,481 | 8/1981 | Wendy | 52/211 |
| 4,663,906 | 5/1987 | Weinar | 52/211 |

*Primary Examiner*—Michael Safavi
*Attorney, Agent, or Firm*—Helfgott & Karas

[57] ABSTRACT

A window and door trim assembly which can be used with siding placed against the walls of a house and includes elongated L-shaped strips fit around the casing of the window or door, and hem strips snapped over forwardly protruding flanges provided on the walls of the facing strips. The hem strips are held on the flanges of the facing strips in a locking engagement therewith but with three gaps produced between the facing surfaces of the flanges and hem strips to compensate for expansion of siding due to heat. Plastic fasteners to secure the facing strips to the siding are of such length that they do not screw into the housing wall. A method of assembling the window and door trim is described.

22 Claims, 4 Drawing Sheets

HOUSE TRIM PANELS FOR USE WITH SIDING AND METHOD OF ASSEMBLING THE PANELS

CROSS REFERENCE TO RELATED APPLICATION

This application is a continuation-in-part of application Ser. No. 394,484 filed Aug. 16, 1989 now abandoned.

FIELD OF THE INVENTION

The present invention relates to house trim panels for use with siding, and more particularly to window, door and corner trim panels for use in conjunction with the siding.

BACKGROUND OF THE INVENTION

Siding is used on houses to protect the exterior of the house and may typically be made of wood, aluminum or vinyl material. When the exterior of a house is initially made of wood, it may later also be covered with aluminum or vinyl siding secured to the wood. Trim panels are required at windows, doors and corners of the house to cover and protect the ends of the siding at these locations.

House trim panels for use with siding have been disclosed by applicant in U.S. Pat. No. 4,389,824 and in U.S. patent application Ser. No. 333,461 filed Apr. 5, 1989.

The trim panels disclosed in U.S. Pat. No. 4,389,824 comprise a receiving strip which is attached to an inner side wall of a window or door casing, and an L-shaped facing strip which is fitted around the casing front corner and over the siding ends. The receiving strip has a folded receiving slot which receives and holds the rear edge region of one leg of the facing strip along the inner casing wall and biases the other leg of the facing strip against the external siding wall.

In U.S. patent application Ser. No. 333,461, there is disclosed a similar receiving strip and facing strip combination in which the receiving strip may be attached to the front exterior casing wall rather than the inner side casing wall, thereby facilitating the nailing of the receiving strip and permitting its use where the window or door is mounted flush with the front wall. The outer hem region of the facing strip overlying the siding is also folded outwardly into an integral decorative hem trim strip and is secured against the siding by L-shaped hooks previously screwed into the house and thereafter inserted and turned to snap lock within the folds of this integral hem strip.

However, although this decorative hem construction both improves the appearance of the strip panels and results in a stronger and more permanent installation, the use of pre-screwed L-hooks inserted and turned within the folds of the hem strip is time consuming and may cause registration problems. In addition, it is difficult to consistently produce a tight water-shedding engagement of the facing strip hem against the siding.

U.S. Pat. No. 4,281,481 discloses a two-piece frame assembly, in which a door trim includes a facing strip and a C-shaped hem strip which is snapped over the outwardly projecting flanges provided on the facing strip, in order to conceal heads of the fasteners nailed into the panel of the door. Such trim assemblies are, however, not suitable for window and door trims used with siding panels which are subject to expansion and buckling due to heat.

SUMMARY OF THE INVENTION

Accordingly, it is an object of the invention to provide house trim panels with facing strips having decorative forwardly raised hem strips that overlie the siding and may be quickly and easily mounted and installed in water-shedding tight engagement with the siding.

Another object of the invention is to provide house trim facing strips having decorative outer edge hem strips which may be mounted by fasteners constructed to pass through the siding only, without damaging the house wall, with the fasteners being concealed from view.

A further object of the invention is to provide house trim facing strips having decorative hem strips which, at the same time, significantly stiffen the facing strip and may be used to connect prefabricated facing strip sections to each other. The hem strips may be pre-cut to fit casings or corners of different sizes, and may be quickly and easily mounted over the ends of the siding sections.

A still further object of the invention is to provide a house trim facing strip that may be directly fastened along its outer edge from the front thereof and which integrally supports a decorative hem strip which conceals the fasteners.

Yet another object of the invention is to provide a prefabricated window or door trim which can fit over a window, door, or the like to provide a decorative and protective finish to siding of a house.

In brief, in accordance with the invention, a house trim assembly is provided for use with siding, which comprises a facing strip including a pair of elongated walls forming a substantially L-shape transverse configuration, an elongated region of at least one elongated wall having a longitudinal edge and two spaced-apart frontally extending, parallel elongated flanges which are of substantially the same configuration, an elongated hem strip placed onto the flanges, and fastening means for securing the facing strip over siding adjacent a window, door or corner of the house. The hem strip has a base section and two legs forming a substantially C-shape configuration. The legs of the hem strip and the flanges of the wall of the facing have respective complementary faces shaped so that the legs engage and seize upon the flanges to ensure engagement of the hem strip onto the flanges. The fastening means, which may be fasteners made, for example, of plastic, are received in the end region of the facing strip wall between the flanges. Each fastener is of such length that when inserted through the facing strip it passes only through the siding without penetrating through the house wall. Such connection ensures that the siding, which may expand due to heat, will not buckle because of being fastened to the house at its ends to thereby accommodate expansion. The fasteners are snapped against, rather than screwed through, the wall of the house.

The flanges of the facing strip and the legs of the hem strip have complementary bent end portions which are constructed so that, in assembly, three gaps are produced between the facing surfaces of the facing strip and the hem strip. Thus, the hem strip is snapped onto the facing strip flanges such that it provides for a good lock of the two parts and yet gives some space for expansion of siding.

According to another feature of the invention, a method of assembling a house trim for use with siding is provided, in which prefabricated facing strip sections are provided, each including a pair of elongated walls forming a substantially L-shaped configuration and having on at least one of said walls two spaced-apart frontally extending, parallel elongated flanges of the same configuration, of which one is located adjacent a longitudinal edge of the one of the walls, and a plurality of spaced-apart oblong holes formed between the flanges. A portion of the walls supporting the flanges are notched and this facing strip is then telescopically inserted behind another longitudinally adjacent facing strip section. Then, a prefabricated elongated hem strip member having a base section and two legs forming a substantially C-shape configuration and having faces complementary to faces of the flanges of the facing strip sections, is snapped over the adjacent flanges of the two telescopically connected, pre-assembled elongated facing strip sections, thereby securing these sections to each other, stiffening the facing strip as a whole and providing a decorative appearance of the house trim.

Further, according to the invention, a method of assembling a house trim frame for a window, air conditioner, doorways, etc., is suggested, wherein prefabricated facing strip sections are provided, each including a pair of elongated walls forming a substantially L-shaped configuration and having on at least one of the walls, two spaced-apart frontally extending, parallel elongated flanges, of which one flange is located adjacent a longitudinal edge of the one of the walls, and a plurality of spaced-apart oblong holes formed between the flanges of the facing strip section wall. One end of each of the sections is mitered and the mitered edges of two facing strip sections are connected to each other by fastening means, such as double-stick tape members, to form a corner subassembly. Prefabricated C-shaped hem strip members are then snapped around the sides and the two corners. An inverted U-shaped facing strip frame is thus fabricated which is then secured to the window.

The aforementioned objects, features and advantages of the invention will, in part, become obvious from the following more detailed description of the invention, taken in conjunction with the accompanying drawing, which form an integral part thereof.

DESCRIPTION OF THE PREFERRED EMBODIMENT

Figure 1:
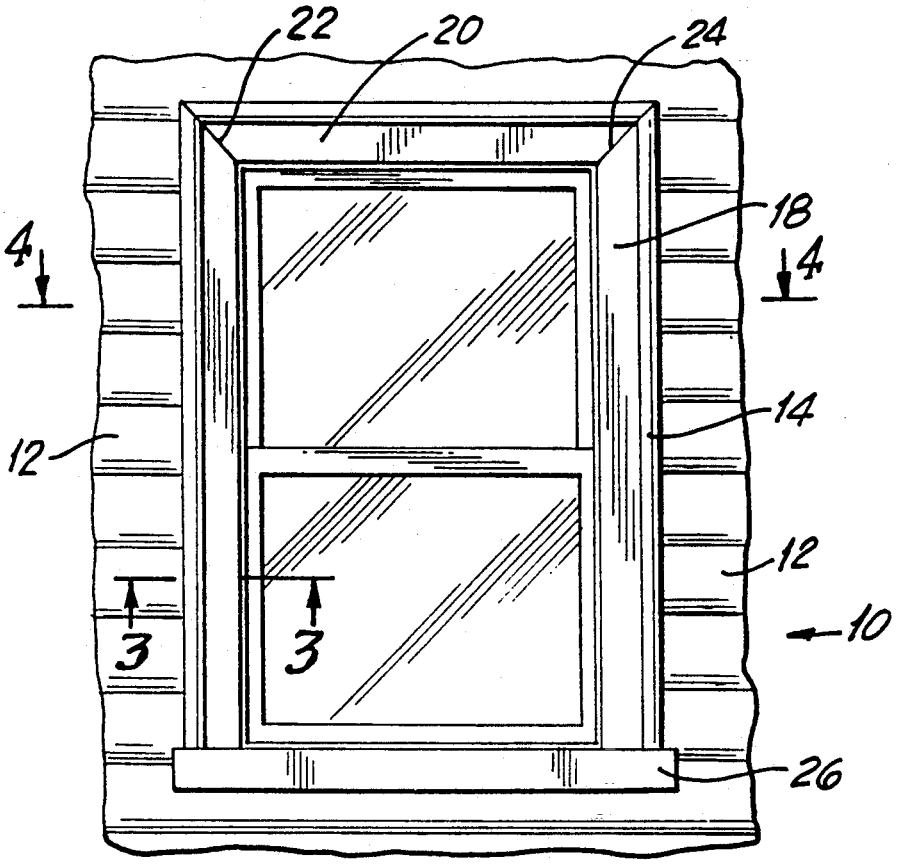
FIG. 1 is a front elevation view of a window incorporating the house trim panels embodying the invention.

Referring now to FIG. 1, there is shown a house section 10 on which there have been placed panels of siding 12, typically made of aluminum or vinyl or other suitable material. A window, 14, has its casing trimmed with side trimming panels 16, 18, and upper trimming panel 20 in accord with the present invention. The side and upper trim panels are mitered at the corners as designated at 22, 24, and a sill cover 26 completes the window trim. While the invention is shown embodied in a window trim, FIG. 1, it may also be applicable to a door trim or other locations of the house having exposed corners.

Figure 2:
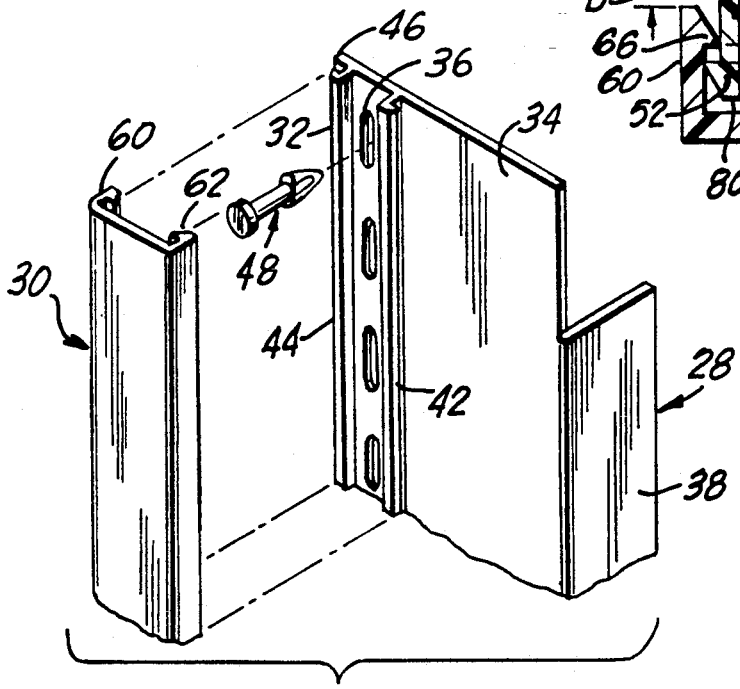
FIG. 2 is an exploded perspective view of the facing strip and hem strip in accordance with one embodiment of the invention.
Figure 3:
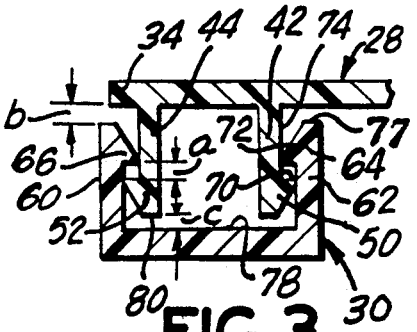
FIG. 3 is a cross-sectional view taken along line 3—3 of FIG. 1, on enlarged scale.
Figure 4:
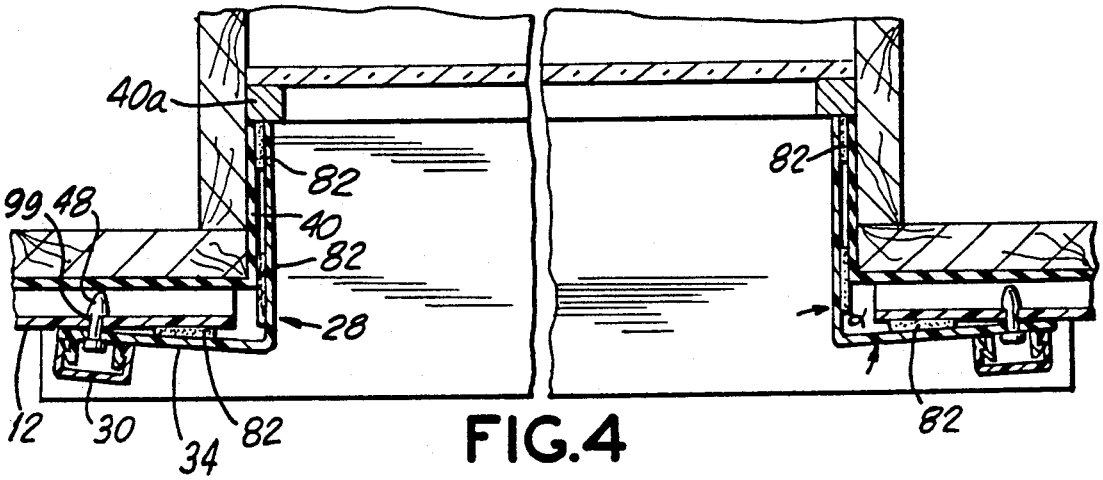
FIG. 4 is a cross-sectional view taken along line 4—4 of FIG. 1.

As best seen in FIGS. 2 through 4, each side and upper panel is comprised of two sections, an elongated L-shaped facing strip 28 and an elongated C-shaped hem strip 30 snapped onto an elongated outer edge region 32 of the facing strip 28.. The facing strip 28 has an L-shaped transverse configuration adapted to fit over the inner corner of the window casing. A front leg 34 of facing strip 28 has, at the outer edge region thereof, longitudinally spaced oblong holes 36 through which the facing strip 28 may be fastened to the front wall of the window casing. The rear leg 38 of facing strip 28 covers the inner side wall of the casing. As seen in FIG. 4, the front leg 34 of the facing strip 28 is adapted to overlie the siding 12 and is bent to an L-shaped $\alpha$ angle of less than 90 degrees, preferably to about 80 degrees, in order to insure that it clamps tightly against the siding to be flush therewith when its rear leg 38 is pushed over the internal side of a gasket 40 provided on the window.

The outer longitudinal edge region 32 of the facing strip 28 contains two spaced-apart, longitudinal, frontally extending flanges 42 and 44, spaced from the outer edge 46 of the facing strip. Longitudinally spaced openings 36 are formed in the wall of the edge region 32 between the flanges 42 and 44. The edge region 32 of strip 28 may be fastened through openings 36 by any suitable means, such as fasteners 48 passing through the siding as shown in FIG. 4. Each frontally extending flange 42, 44 comprises a bent up edge portion on the front side of the facing strip 28. The C-shaped hem 30 is shaped and dimensioned to snap fit over the two flanges 42, 44, thereby overlying and concealing the fasteners 48 inserted through oblong openings 36. In this embodiment, the two flanges 42 and 44 are shaped to have outwardly bent end or edge portions 50 and 52, respectively, as shown in FIG. 3. The C-shaped hem strip 30, on the other hand, has its two protruding legs 60, 62, shaped and dimensioned to have corresponding inwardly bent end or edge portions 64, 66, respectively, thereby to interlock with the bent portions 50, 52 of flanges 42 and 44. More specifically, the flanges of the facing strip 28 and the legs of the hem strip 30 are formed such that the distance between the distal outer edges of the two flanges 42, 44, and the maximum inner surface distance between the two legs 60, 62 of the hem strip 30 are made approximately equal, and the opening between the two legs, 60, 62 is made sufficient to permit one leg of the hem strip 30 to be hooked over one flange, and the hem strip then pivoted to snap its other leg into interlocking position over the other flange.

The hem strip assembly is shown in detail in FIG. 3. The flanges 42, 44 of the facing strip 28 and the legs 60, 62 with end portions 64, 66 of the cap or hem strip 30 are formed such that when assembled, three gaps or clearances result between the facing surfaces of the flanges of the facing strip 28 and the legs of hem strip 30. The first clearance is identified in FIG. 3 as gap "a" between two horizontally extending facing surfaces 70 and 72 of bent end portions 50, 52 of flanges 42, 44 and bent end portions 64,66 of legs 60, 62 of the cap, respectively. The second gap or clearance "b" results in assembly between the ends 75, 77 of the legs 60, 62 and the front surface 34 of the strip 28. The third gap or clearance "c" is produced in the assembled condition of the trim between the facing surfaces 78 and 80 of the base section of the hem strip and the distal end of each flange of the facing strip 28. These three gaps formed between the respective surfaces of the facing strip 28 and hem strip 30, facing each other, not only facilitate a snap-on action of the hem strip on the facing strip but also provide a space for expansion of the siding due to heat or compensation for buckling due to moisture. The three-gap structure ensures a reliable lock of the hem strip on the facing strip and yet permits tolerances in manufacture.

Facing strip 28 may be made of relatively thin aluminum or vinyl material thereby to have sufficient flexibility and resilience to permit this snap over action, and thereafter to hold the hem strip firmly in place.

Referring now to FIG. 4, the window trim is installed by first placing the insulation gasket strip 40 made of rubber, around the entire window. Facing strip 28 is a prefabricated strip, as will be discussed in detail below, and has a number of double-side stick tape members 82 of commercially available type placed on the back side of each leg of the strip and spaced from each other along the length of the strip. These double-stick tape members are normally provided at both opposing surfaces thereof with an adhesive layer which is covered with an easily-removable protective sheathing, such as Mylar. In the prefabricated facing strip, the exposed or outer adhesive-carrying surfaces of the double-stick members 82 are covered with Mylar strips which are removed right before the facing strip 28 is installed over the siding 12 and insulation gasket 40. As seen in FIG. 4, the facing strip 28 is placed over the gasket 40 at the corner of the casing of the window with the stick tape members 82 facing gasket 40. The inner leg 38 of the facing strip is trimmed to abut with its edge against a blind stop 40*a*. As the Mylar coverings are removed from the surfaces of double-stick members 82, facing gasket 40, the inner leg 38 of the facing strip becomes secured to the window casing. The front leg 34 of the facing strip is then secured to the front face of siding 12 by double-stick tape members 82, attached to the back side of the front leg at an intermediate section thereof, and by fasteners 48, passing through holes 36 in the facing strip edge region 32 and through the siding 12 towards the insulating strip 40 of the front house wall.

At the upper corners of the window, the larger front legs of the side and upper facing strips may be overlapped or mitered. The corner facing strip members may also be prefabricated as will be explained below.

Figure 10:
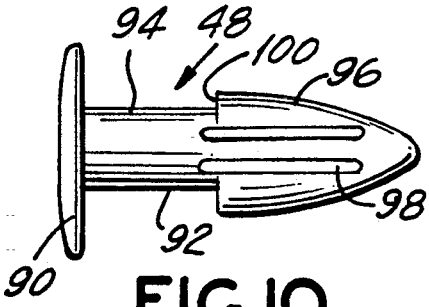
FIG. 10 is a side view of a fastener for connecting the hem strip to the facing strip in assembly.
Figure 11:
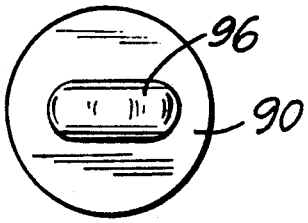
FIG. 11 is an end plan view of the fastener of FIG. 10.

Fastener 48, shown in detail in FIGS. 10 and 11, may be made of plastic, for example, by injection molding, and has a substantially flat head portion 90 of a circular configuration and an elongated portion 92 which includes an intermediate section 94 of an oval cross-section and an enlarged end section 96 tapering towards the distal end of the fastener. End section 96, which has elongated grooves formed therein, is also of non-circular cross-section. The smaller diameter or width of intermediate section 94 and the end section 96 is such that each fastener 48 can easily pass through a transverse width of each oblong hole 36 of the facing strip whereas the larger width or diameter of intermediate section 94 is such that it still permits passage of this section through hole 36. On the other hand, the larger width of the end section 96 is greater than the width of oblong hole 36. A number of circular openings 99 (FIG. 4) is provided in the siding wall at locations corresponding to those of oblong holes 36 for receiving fasteners 48 through the siding. Grooved, non-circular tapered section 96 of plastic fastener 48 thus has a ribbed outer surface which permits certain flexibility and thereby compression of the fastener as the latter is snapped through hole 36 of the facing strip and through opening 99 of the siding 12 while shoulder 100 between the intermediate section 94 and end tapered section 96 seizes upon opening 99 in the siding, so that, once fastener 48 has been snapped through hole 36 into the siding wall, it is rigidly secured in place, thus holding the edge portion 32 of the facing strip in abutment against the siding wall.

The elongation of oblong holes 36 permits adjustability of the facing strip along the siding wall so as to easily align the oblong hole 36 with respective round opening 99 to snap the fastener therethrough.

Figure 6:
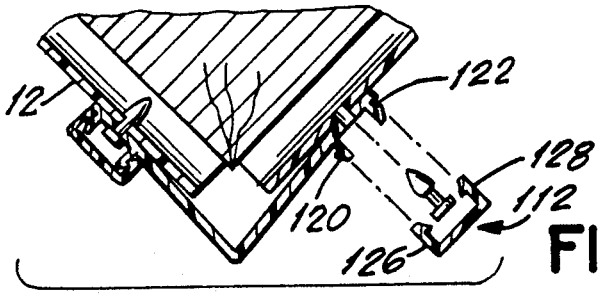
FIG. 6 is a cross-sectional view taken along line 6—6 of FIG. 5.

According to the invention the overall length of fastener 48 is such that, after the fastener has been snapped into the siding through the respective oblong hole 36, it's distal end does not penetrate the front wall of the house, as seen in FIGS. 4 and 6. The fastener 48, inserted through the siding, only snaps into the siding, without being screwed into the house or window panel, whereby buckling of the siding, which normally occurs due to expansion caused by heat, when the facing strip and the siding are nailed to the housing wall, is prevented. By assembling of the facing strip to the siding by fasteners 48 snapped through the siding only, expansion of the siding due to heat will be accommodated.

It is appreciated that the installation of the trim is quite simple, requiring very little labor time. The facing strip 28 is held in place against the siding 12 and gasket 40 and, as the Mylar coverings are removed from the exposed sides of the double-stick tape members 82, the facing strip is pushed against the walls of the siding 12 and gasket 40 and, after fasteners 48 have been snapped through holes 36 into the respective holes made in the siding, the hem strip 30, cut to size, is snapped onto the flanges of the facing strip 28, as described above. The entire assembly is strong and resistant to corrosion and buckling. The location of fasteners 48 along the outer edge region insures a water-shedding tight engagement over the ends of the siding.

Additionally, a receiving strip having a slot receiving a folded part made in the facing strip may be attached to the window casing as was heretofore described in the aforementioned U.S. Pat. No. 4,389,824 and application Ser. No. 333,461.

Figure 5:
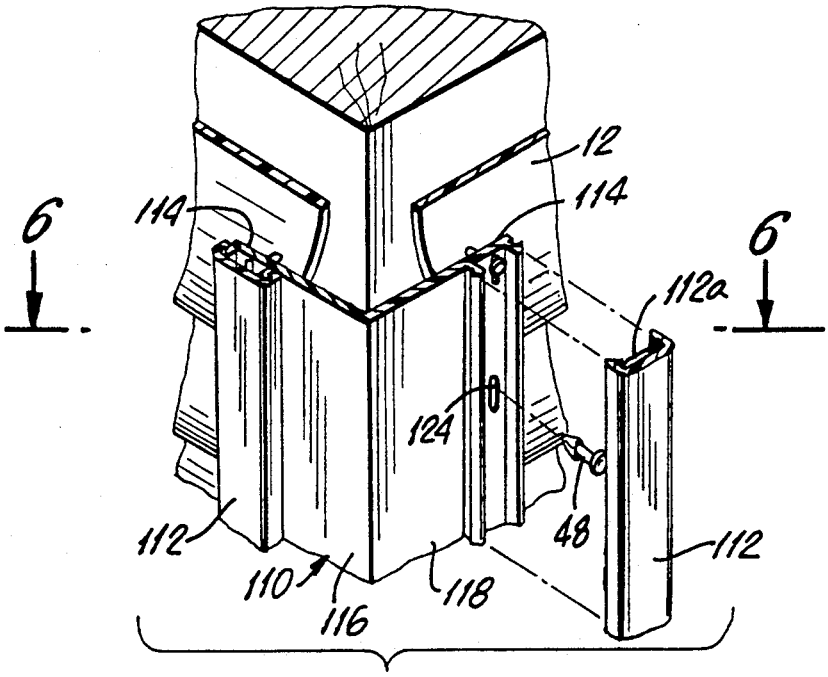
FIG. 5 is a front perspective view of a house corner trim panel embodying the invention.

Referring now to FIGS. 5 and 6, there is shown an embodiment of the invention in a corner trim panel comprising an elongated L-shaped facing strip 110 which carries two substantially C-shaped elongated hem strips 112 snapped onto panels along the outer edge regions 114 of each of its two legs 116, 118. Each outer region 114 contains two substantially parallel frontally extending longitudinal flanges 120, 122 spaced from each other and a plurality of longitudinally spaced openings 124 between the flanges. Both flanges 120 and 122 have outwardly bent end portions along their outer side surfaces while opposing legs 126, 128 of hem strip 112 have inwardly bent end portions conforming in configuration to the outwardly bent end portions of flanges 120, 122, similarly to the embodiment of FIGS. 3 and 4. The maximum distance between the inner surfaces between the two legs 126, 128 of hem strip 126 is approximately equal to the maximum distance between the outer surfaces of flanges 120, 122, while the distance between the outer edges of the two legs 126, 128 is slightly less than this maximum distance between the flange outer surfaces so that the hem strip 112 may be snapped over and onto the flanges 120, 122, as shown. Similarly to the embodiment shown in FIGS. 3 and 4, three gaps or clearances are produced between the cap or hem strip 112 and the flanges of the facing strip 110 when the cap is snapped over the flanges. In a modified embodiment, ½"×1/16" aluminum bar 112*a* may be taped inside the hem strip 112 for further rigidity, as shown in FIG. 5.

The corner trim panel may be installed by merely placing the L-shaped facing strip 110 over the siding panels at the corner, fastening each leg 116, 118 of the facing strip through holes 124 and into the siding 12, and then snapping the hem strips 112 onto the flanges 120, 122 of the facing strip. Similarly to the embodiment of FIG. 4 fasteners 48 are not screwed into the housing wall, to compensate for expansion due to heat. The facing strip and hem strips may be pre-cut to proper length or may be cut immediately prior to final assembly.

Figure 9:
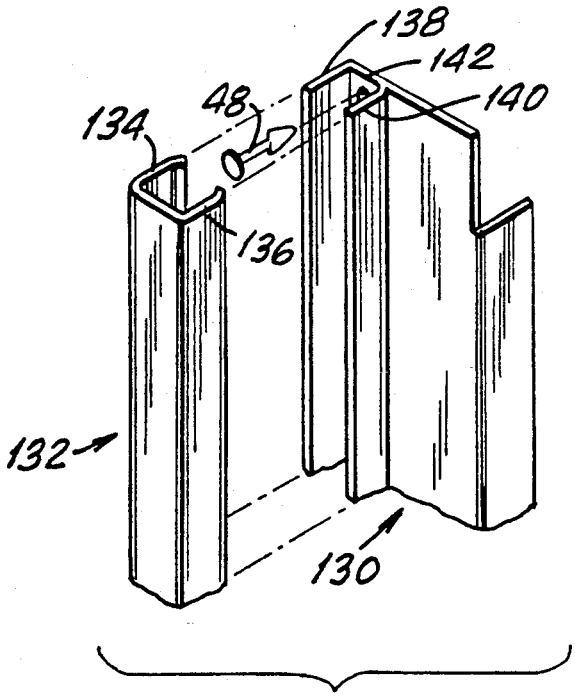
FIG. 9 is an exploded perspective view of the facing strip and hem strip in accordance with another embodiment of the invention.

Referring now to FIG. 9, there is shown another embodiment of the invention as applied to a window facing strip 130 which is shown in an exploded perspective view. In this embodiment, the two legs 134, 136 of the C-shaped hem strip 132 have a longer transverse dimension than the C-shaped hem strips of FIGS. 3, 4, 5 and 6. The front side faces of hem strip 98 are flat, rather than curved with only rounded corners. The two parallel frontally extending flanges 138 and 140 along the edge region 142 of the facing strip 130 likewise have a longer transverse dimension and are flat at the sides and are rounded at the corners adjoining the base between the flanges at the flat front face of the facing strip. The longer flat sides of the flanges and C-shaped hem strip legs provide greater flexibility, thereby facilitating the installation of the hem strip over the flanges. The flat front and side surfaces of the hem strip provide a more tailored appearance. The rounded corners at the edges of the hem strip and at the base of the flanges insure that the hem strip will be held firmly in place against transverse movement. With this embodiment, plastic fasteners 48 of FIGS. 10 and 11, which fasteners pass through the oblong holes made between the flanges of the facing strip 130, and the double-stick tape members 82 placed on the back side of the facing strip are used to assemble the facing strip to the siding, similarly to the embodiment of FIG. 4.

Figure 7:
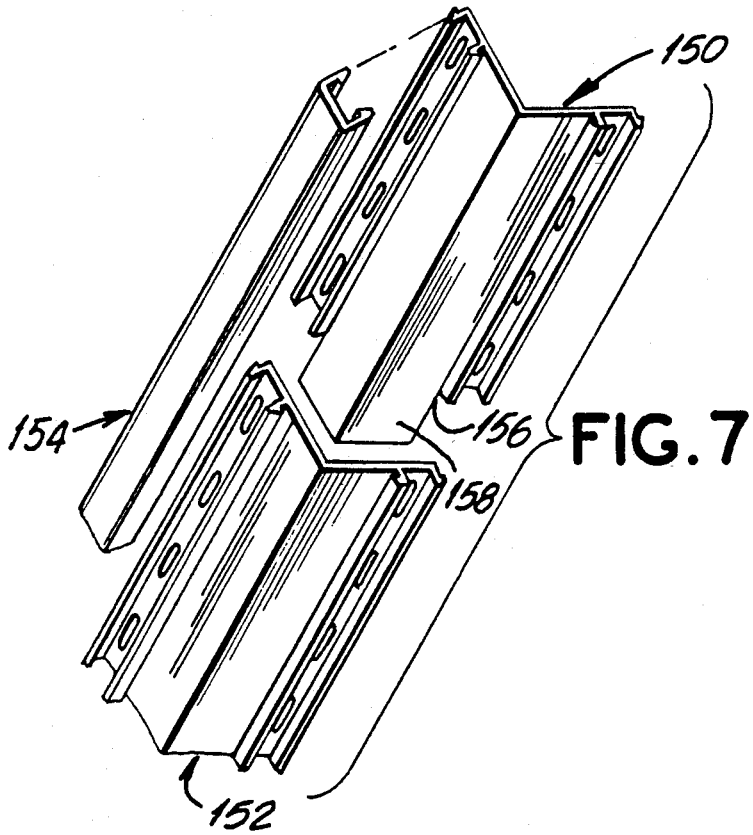
FIG. 7 is an exploded perspective view of two facing strip members and a hem strip to be assembled in accordance with a method of the present invention.

Referring now to FIG. 7, two elongated, L-shaped facing strip members 150 and 152 of the construction explained in detail in connection with the embodiment of FIG. 5, may be coupled to each other by two C-shaped hem strip members 154 (only one is shown) snapped onto the flanges at the opposite outer edges of the two strip members being interconnected. Before connecting two strip members 150, 152 to each other, two flanged corners of the end portion of one of them (150 in the drawing) are cut off, as shown at 156, so that a remaining notched end section 158 may be telescopically inserted into the longitudinally adjacent strip member 152 and the flanged outer edges of the upper strip member 150 would abut the flanged outer edges of the lower strip member 152. The cap or hem strip 154 will be then snapped onto the flanges of both strip members 150, 152 to secure these two strip members to one another. Another cap would be snapped onto the opposite edge. A number of facing strip members can be secured to each other in such a fashion to produce a corner trim of a desired length. It should be appreciated that the cap according to the present invention not only functions as a connecting member but also as a finishing member and a stiffening element for the strip sections forming the door, window or corner trim.

Figure 8A:
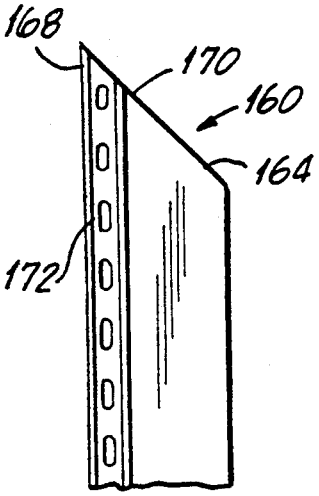
FIGS. 8A to 8G show steps of assembling a house trim panel according to the method of the present invention.
Figure 8B:
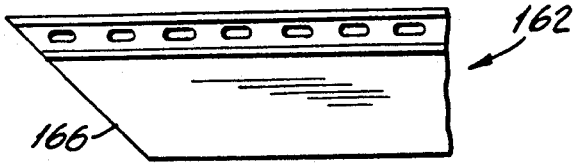
Figure 8D:
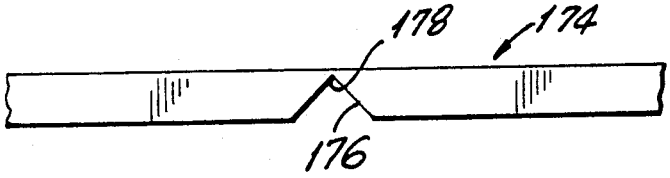
Figure 8C:
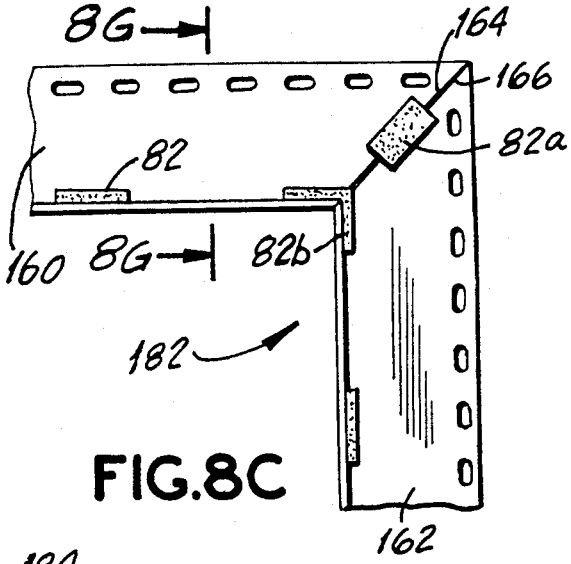
Figure 8E:
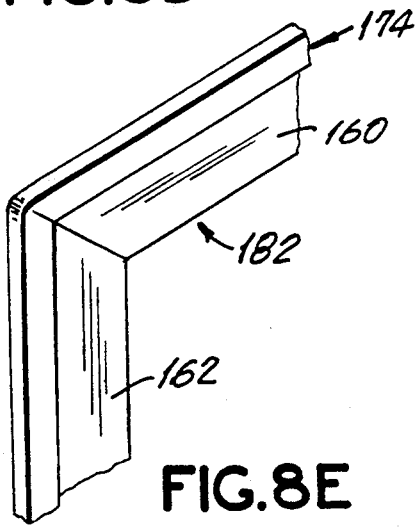
Figure 8F:
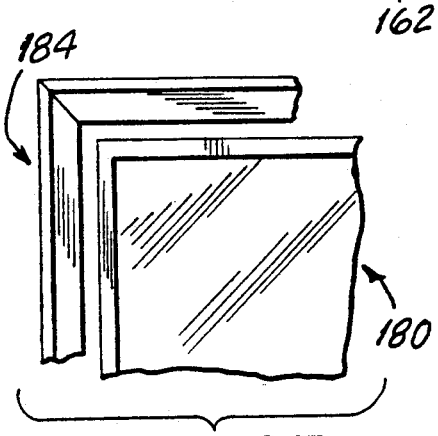
Figure 8G:
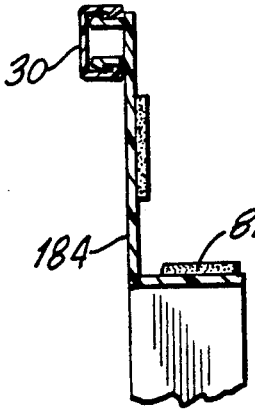

FIGS. 8A–8G show various steps of the assembly of a prefabricated trim frame which can be directly mounted onto the window or door. FIGS. 8A and 8B illustrate two elongated L-shaped facing strip members 160, 162, each being mitered at edge 164, 166, respectively. The strip members 160, 162 are connected to each other at their mitered edges to form one corner of the frame as shown in FIG. 8C. Each facing strip member is provided with two outwardly projecting elongated flanges 168, 170 at the outer edge thereof and oblong holes 172 for fasteners, as explained above. When placed adjacent to each other at their mitered edges 164, 166, the strip members 160, 162 are secured to each other first by placing a double-stick tape member 82*a* along the joint line of the two legs of the strip members on their back sides. A second double-stick tape member 82*b* is placed over the joint line of the other two legs of the facing strip members 160, 162 so as to overlap the corner portions of both L-shaped strip sections being connected. A plurality of double-stick tape members 82, further provided along the length of each of the strip member, have their outer surfaces covered with Mylar sheathings which are removed only for attachment of the facing strip to the window or door casing 180 (FIG. 8F). FIG. 8D shows an elongated edge strip member 174 which has a V-shaped notch 176 leaving a bridge portion 178, around which strip member 174 may be bent and snapped over the edges of the corner strip subassembly 182, as shown in FIG. 8E. It is to be appreciated that two or four corners of the frame can be connected to each other in the fashion shown in FIGS. 8C and 8E. Then, after pulling off all Mylar coverings from the double-stick tape members 82, the assembled frame 184 is snapped on the window or door casing 180, as shown in FIG. 8F. FIG. 8G shows a portion of frame 184 with cap 30 snapped onto the flanges outwardly protecting from the frame. This type of prefabricated frame can also be used indoors, as for example, around air conditioners, or doorways, etc. In this way no nails need be used and the walls or plastorboard won't be cracked.

It will thus be seen that in accord with the invention there has been provided a house trim for use with siding or walls wherein a decorative hem strip may be quickly and easily installed. The invention may also be applied to window and door casings, or to house corners.

The described components of the invention, including particularly the facing strips for window, door or corner trim and the hem strips are preferably made of aluminum or vinyl material. If aluminum, the strips may conveniently be extruded or fabricated from sheet material. The aluminium should be of an order such that the facing strip flanges and hem strip legs will have sufficient flexibility and strength for snap together mating and self supporting maintenance. If the components are made with vinyl material, they may be molded or extruded and also be of sufficient flexibility.

There has been disclosed heretofore the best embodiment of the invention presently contemplated. However, it is to be understood that various changes and modifications may be made thereto without departing from the spirit of the invention.

What is claimed is:

1. A house trim assembly for use with siding comprising:

a facing strip including a pair of elongated walls forming a substantially L-shape transverse configuration, an elongated end region of at least one elongated wall having a longitudinal edge and two spaced-apart frontally extending, parallel elongated flanges which are of substantially the same configuration, one of said flanges being located adjacent said longitudinal edge;

an elongated hem strip placed onto said flanges and having a base section and two legs forming a substantially C-shape configuration;

said legs and said flanges having respective complementary faces shaped so that said legs engage and seize upon said flanges to ensure a locking engagement of said hem strip onto said flanges;

first fastening means for securing said facing strip over siding adjacent a window, door or corner of the house, said first fastening means being received in said end region between said flanges and being of such length that they pass through said siding without penetrating a wall of the house; and second fastening means provided on a back side of said facing strip for securing said facing strip to the window, door or corner of the house, said second fastening means including double-stick tape members secured to each of said elongated walls and spaced from each other along the elongation of each of said walls.

2. The house trim assembly of claim 1, wherein said facing strip and said legs of said hem strip are constructed so that, upon said engagement, three gaps are produced between facing surfaces of said facing strip and said hem strip.

3. The house trim assembly of claim 1, wherein each of said double-stick tape members has an external adhesive-carrying surface which is covered with a removable non-stick sheathing.

4. The house trim assembly of claim 1, wherein the double-stick members secured to said at least one elongated wall are spaced from said two spaced-apart flanges in a transverse direction of said wall.

5. The house trim assembly of claim 2, wherein each of said flanges has an outwardly bent end portion and each of said legs has an inwardly bent end portion.

6. The house trim assembly of claim 5, wherein said outwardly bent end portion has a first surface extending transversely of a respective flange and said inwardly bent end portion has a second surface extending transversely of a respective leg, said first surface being parallel to and spaced from said second surface by a first one of said three gaps.

7. The house assembly of claim 6, wherein each of said legs has an inner distal end which is spaced from an inner surface of said facing strip by a second one of said three gaps.

8. The house trim assembly of claim 7, wherein said outwardly bent end portion has a distal end surface which is parallel to and spaced from a surface of said base section of said hem strip by a third one of said three gaps.

9. The house trim assembly of claim 8, wherein said gaps are defined in a direction transversal to said at least one elongated wall.

10. The house trim assembly of claim 1, wherein said at least one elongated wall includes a plurality of oblong holes spaced from each other along an axis of elongation of said wall, and said first fastening means include a plurality of fasteners insertable through said oblong holes to be snapped into the siding.

11. The house trim assembly of claim 10, wherein said oblong holes have a greater dimension thereof extending along said axis of elongation.

12. The house trim assembly of claim 10, wherein each of said fasteners include a head portion, an intermediate portion and an enlarged end portion tapering towards a distal end of the fastener.

13. The house trim assembly of claim 12, wherein said intermediate portion is non-circular in cross-section.

14. The house trim assembly of claim 12, wherein said enlarged end portion is non-circular in cross-section.

15. The house trim assembly of claim 14, wherein said enlarged end portion is substantially oval in cross-section.

16. The house trim assembly of claim 14, wherein a larger diameter of said end portion is greater than a smaller dimension of each of said holes and smaller than a larger dimension of each of said holes.

17. The house trim assembly of claim 10, wherein each of said fasteners is made of plastic.

18. The house trim assembly of claim 1, wherein said facing strip and said hem strip are made of aluminum, and said flanges and said hem strip have sufficient resilience to provide said engagement therebetween.

19. The house trim assembly of claim 1, wherein said facing strip and said hem strip are made of vinyl material, and said flanges and said legs of said hem strip have sufficient resilience to provide said engagement therebetween.

20. The housing trim assembly of claim 10, wherein said hem strip overlays and conceals said fasteners.

21. The house trim assembly of claim 1, wherein each flange has a flat outer side surface and each leg has a flat inner side surface, the dimension between the outer side surfaces of the two flanges being slightly less than the dimension between the inner side surfaces of the two legs.

22. The house trim assembly of claim 2, wherein said two flanges each have a distal ridge projecting away from one another and said two legs each have a distal ridge projecting toward one another, said respective pairs of flange and leg ridges being adapted to interlock with one another leaving said three gaps between said facing surfaces.

* * * * *